United States Patent [19]

Irlam et al.

[11] Patent Number: 4,707,288

[45] Date of Patent: Nov. 17, 1987

[54] PROCESS FOR PREPARING DETERGENT BARS

[75] Inventors: Geoffrey Irlam, Birkenhead; Ian J. Smith, Cambridge, both of England

[73] Assignee: Lever Brothers Company, New York, N.Y.

[21] Appl. No.: 783,980

[22] Filed: Oct. 3, 1985

[30] Foreign Application Priority Data

Oct. 8, 1984 [GB] United Kingdom ..... 8425369

[51] Int. Cl.[4] ..... C11D 9/32; C11D 13/18

[52] U.S. Cl. ..... 252/121; 252/108; 252/132; 252/DIG. 16

[58] Field of Search ..... 252/108, 121, 132, DIG. 16

[56] References Cited

U.S. PATENT DOCUMENTS

| | | | |
|---|---|---|---|
| 3,376,229 | 4/1968 | Haass | 252/117 |
| 3,557,006 | 1/1971 | Ferrara et al. | 252/117 |
| 3,835,058 | 9/1974 | White | 252/121 |
| 3,879,309 | 4/1975 | Gatti et al. | 252/117 |
| 4,007,125 | 2/1977 | Prince | 252/117 |
| 4,180,470 | 12/1979 | Tokosh et al. | 252/121 |
| 4,584,126 | 4/1986 | Joshi | 252/368 |
| 4,612,136 | 9/1986 | Novakovic et al. | 252/134 |
| 4,663,070 | 5/1987 | Dobrovolny et al. | 252/121 |

FOREIGN PATENT DOCUMENTS

| | | |
|---|---|---|
| 359893 | 10/1931 | United Kingdom . |
| 783027 | 9/1957 | United Kingdom . |
| 796627 | 6/1958 | United Kingdom . |
| 954833 | 4/1964 | United Kingdom . |
| 986007 | 4/1965 | United Kingdom . |
| 1001962 | 8/1965 | United Kingdom . |
| 1314604 | 4/1973 | United Kingdom . |
| 1460442 | 1/1977 | United Kingdom . |
| 1477897 | 6/1977 | United Kingdom . |
| 2118854 | 11/1983 | United Kingdom . |

OTHER PUBLICATIONS

"Fenopon Brochure" (FAF).

*Primary Examiner*—Prince E. Willis

*Attorney, Agent, or Firm*—Milton L. Honig; James J. Farrell

[57] ABSTRACT

The present invention provides a process for mixing water soluble salts of long chain ($C_8$ to $C_{22}$) monocarboxylic acids and water soluble acyl ($C_8$ to $C_{22}$) isethionates whrein the two materials are mixed and subjected to temperatures in the range from about 55° C. up to about 90° C. under conditions of shear. Preferably the materials are mixed in particulate form. The weight ratio of monocarboxylic acid salts to isethionates is preferably in the range of from 10:90 to 95:5. Suitably the present process is performed by use of a cavity transfer mixer. The product of the present process can have a smooth feel both initially and during use.

6 Claims, 5 Drawing Figures

PROCESS FOR PREPARING DETERGENT BARS

FIELD OF INVENTION

This invention relates to a process for mixing water soluble salts of long chain (C8 to C22) monocarboxylic acids with water soluble acyl (C8 to C22) isethionates. The mixed detergent system may be processed into bar form.

BACKGROUND

There is a general requirement to provide detergent bars having acceptable properties. Mixtures of soaps and acyl isethionates have been found to provide such formulations. When mixing soap and acyl isethionate bases it has however been found that the product detergent bar may have a gritty feel during use.

PRIOR LITERATURE

U.S. Pat. No. 2,894,912 (Geitz) describes mixing soap (up to 25%) with acyl isethionate at temperatures above 85° C., above 115° C. the blend is said to be smooth.

UK 8308631 (Unilever Plc) discloses the use of cavity transfer mixers to reduce the grittiness in a soap composition; acyl isethionates are noted as optional ingredients.

U.S. Pat. No. 3,376,229 (Haass) soap (up to 25%) is mixed with acyl isethionate at 112° C. for 15 minutes.

NL 6603918 (Unilever) mixes soap and acyl isethionate in liquid form above 90° C. to reduce grit in product. No information on the mixer is provided.

GENERAL DESCRIPTION

According to the present invention there is provided a process for mixing water soluble salts of long chain ($C_8$ to $C_{22}$) monocarboxylic acids and water soluble acyl ($C_8$ to $C_{22}$) isethionates wherein the two materials are mixed and subjected to temperatures in the range from about 55° C. up to about 90° C. under conditions of shear.

Preferably the materials are mixed in the ratio of monocarboxylic acid salts to isethionates of from about 10:90 to about 95:5 by weight. More preferably the weight ratio of monocarboxylic acid salts to isethionates is from about 80:20 to about 60:40.

The temperatures of mixing are measured at the outlet of the shear producing device. The shear conditions are preferably high shear conditions and are preferably provided by a cavity transfer mixer. Preferably the mixing under shear is performed in an enclosed environment; this feature can assist in ensuring consistency of composition during mixing.

The products of the present process can have a smooth feel both initially and during use. The present process is particularly suitable where the starting materials are in solid particulate form. The feedstocks are suitably in the form of extrudates or milled particulates, which forms are usually referred to as "chips". Thus the present process is particularly directed to obtaining mixtures of detergent actives provided in solid form.

The mixture may be extruded in the form of noodles for subsequent processing or, more preferably, it may be extruded in the form of billets and processed to form bars for example by cutting and stamping.

The present invention is directed to mixtures of soaps and acyl isethionates and these detergent actives, which are well characterised in the literature, can be prepared using commercial processes and feedstocks. The fatty acid feedstock for the soap component can be obtained from animal and/or plant sources; synthetic acids obtained from petroleum sources may alternatively be used.

The acyl isethionate component may be prepared by direct esterification of an alkali metal isethionate or by reaction of the acyl chloride with isethionic acid and subsequent neutralisation.

The water soluble soaps and acyl isethionates used will usually be the sodium salts but potassium salts may be present and ammonium, including short alkyl substituted ammonium, salts may be present in some formulations.

In a preferred process the mixture of materials is subjected to substantially even shear by passing the material at an angle through a plurality of shear zone areas formed within the detergent material bulk by relative movement of surfaces between which the material passes, the shear zone areas being formed within the material by entraining temporarily material in the surfaces so that a velocity component of the material is altered by the relative movement during entrainment. Examples of this class of apparatus are disclosed in UK patent application 8308656 of Unilever Plc (published No. 2118854); the disclosure of which is incorporated by reference.

A particularly preferred way of performing the present process involves the use of an apparatus in which the mixture is passed between two closely spaced mutually displaceable surfaces, each having a pattern of cavities which overlap during movement of the surfaces, so that material moved between the surfaces traces a path through cavities alternately in each surface so that the bulk of the material passes through the shear zone in the material generated by displacement of the surfaces. Preferably the apparatus has cylindrical geometry. This form of apparatus is termed a cavity transfer mixer.

Another way of performing the present process involves the use of a type of apparatus which forms shear zones by passing material alternately through apertures in stator and rotor blades. Material is entrained in apertures during passage through the plates. An equivalent construction has rotating arms or blades between which the material is entrained. The surfaces must have sufficient thickness to entrain a material as it passes through the surface.

Material is forced through the mixer using auxiliary equipment as the rotor is turned. Examples of the auxiliary equipment are screw extruders and piston rams. The auxiliary equipment is preferably operated separately from the mixer so that the throughput and work performed on it can be separately varied. The separate operation may be achieved by arranging the auxiliary equipment to provide material for processing at an angle to the centre line of the shear-producing device. This arrangement allows rotational energy to be supplied to the device producing shear around its centre line. An in-line arrangement is more easily achieved when the external member of the device is the rotor. Separate operation of the device and auxiliary equipment can assist in providing control of the processing.

In general a variety of cavity shapes can be used in cavity transfer mixers, for example Metal Box (UK 930 339) discloses longitudinal slots in the two surfaces. The stator and rotor may carry slots, for example six to twelve, spaced around their periphery and extending along their whole length. A preferred arrangement of cavities is illustrated in European Patent Application 81304235.5 (RAPRA).

Embodiments of the present invention will now be described with reference to the accompanying diagrammatic drawings in which.

Figure 1:
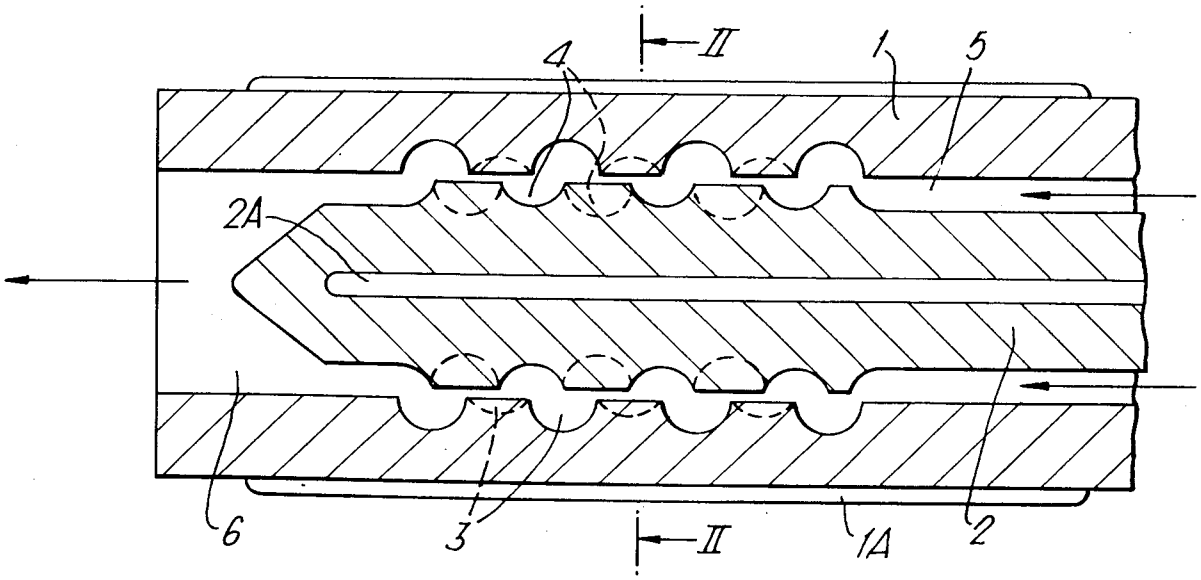
FIG. 1 is a longitudinal section of a cavity transfer mixer with cylindrical geometry.

A cavity transfer mixer is shown in FIG. 1 in longitudinal section. This comprises a hollow cylindrical stator member 1, a cylindrical rotor member 2 journalled for rotation within the stator with a sliding fit, the facing cylindrical surfaces of the rotor and stator carrying respective pluralities of parallel, circumferentially extending rows of cavities which are disposed with:

(a) the cavities in adjacent rows on the stator circumferentially offset;

(b) the cavities in adjacent rows on the rotor circumferentially offset; and (c) the rows of cavities on the stator and rotor axially offset.

Figure 2:
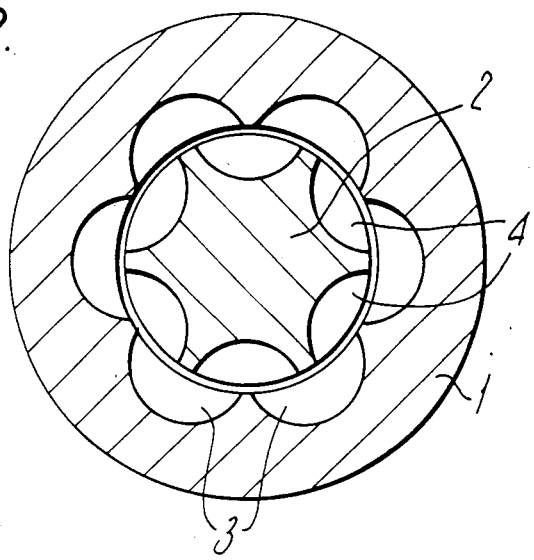
FIG. 2 is a transverse section along the line II—II on FIG. 1.
Figure 3:
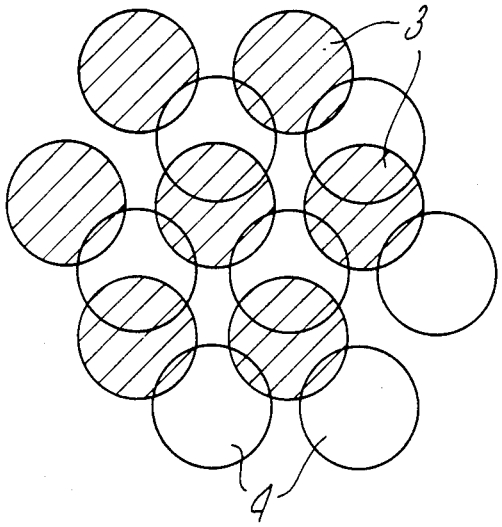
FIG. 3 illustrates the pattern of cavities in the device of FIG. 1.

The pattern of cavities carried on the stator 3 and rotor 4 are illustrated on FIG. 3. The cavities 3 on the stator are shown hatched. The overlap between patterns of cavities 3, 4 is also shown in FIG. 2. A liquid jacket lA is provided for the application of temperature control by the passage of heating or cooling liquid for example water or oil. A temperature control conduit 2A is provided in the rotor.

The material passing through the device moves through the cavities alternately on the opposing faces of the stator and rotor. The cavities immediately behind those shown in section are indicated by dotted profiles on FIG. 1 to allow the repeating pattern to be seen.

The material flow is divided between pairs of adjacent cavities on the same rotor or stator face because of the overlapping position of the cavity on the opposite stator or rotor face.

The whole or bulk of the material flow is subjected to considerable working during its passage through the shear zone generated by the mutual displacement of the short period in each cavity during passage and thus one of its velocity components is altered.

The mixer had a rotor radius of 2.54 cm with 36 hemispherical cavities (radius 0.9 cm) arranged in six rows of six cavities. The internal surface of the stator carried seven rows of six cavities to provide cavity overlap at the entry and exit. The material to be worked was injected into the device through channel 5, which communicates with the annular space between the rotor and stator, during operation by a screw extruder. The material left the device through nozzle 6.

Figure 4:
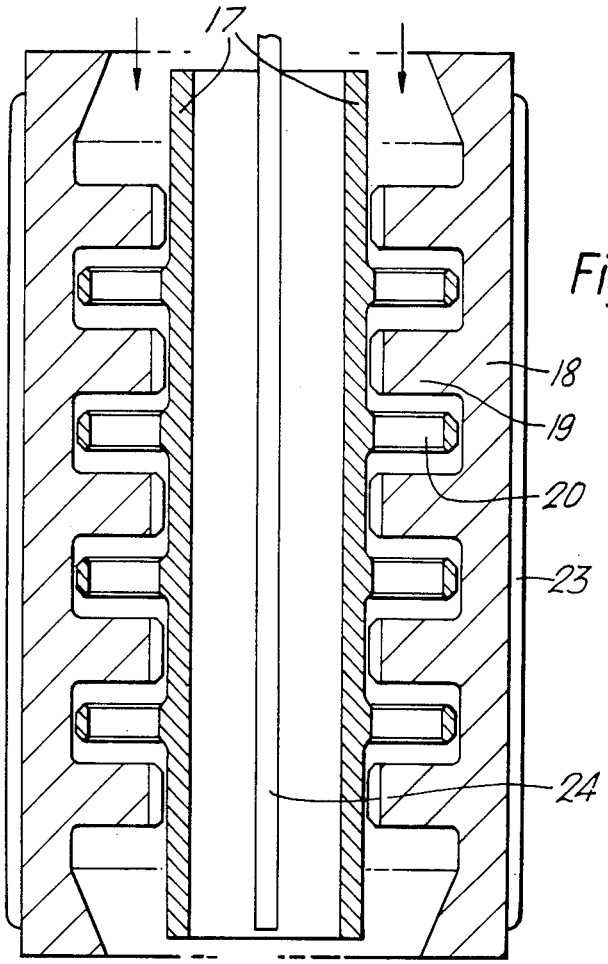
FIG. 4 is a longitudinal section of a device in which material is passed through a series of apertured discs.

A device capable of generating a series of separate shear zone areas is shown in longitudinal section in FIG. 4. An inner cylindrical rotor 17 is journalled for rotation within cylindrical stator 18. The length of the device measured between the outer surfaces of the two end discs is 10 cm and the stator has an internal diameter of 6.5 cm. The stator 18 carries five inwardly directed discs 19 which are arranged alternately with four discs 20 extending outward from rotor 17.

Figure 5:
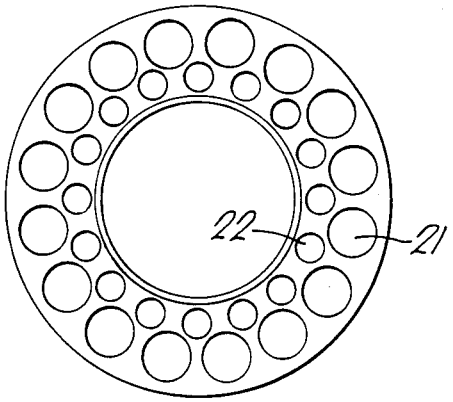
FIG. 5 is a view of an apertured disc.

Each of the nine discs has the pattern of apertures shown in FIG. 5. The apertures 21 in the outer ring have a diameter of 0.8 cm and apertures 22 a diameter of 0.5 cm.

Material is moved through the device in the direction of the arrows by means of auxiliary apparatus, for example a soap plodder. The material passes through the apertures in the nine discs but rotation of rotor 17 causes the formation of a shear zone area between each pair of discs as the material is entrained in the apertures of each disc.

Thermal control means can be mounted on either or both the stator and rotor. A jacket 23 is shown in thermal contact with stator 18, a conduit 24 is positioned within rotor 17.

The discs 19 had a thickness of 1.0 cm and the discs 20 a thickness of 0.6 cm. The periphery of each disc was closely spaced from the adjacent surface of the stator or rotor to ensure all the material passing through the device passed through the shear zone areas.

The strength of the shear zone area at any point is proportional to the distance (d) of the point from the rotational axis. The presence of the rotor 17 occupying the central axis of the device ensures all the material is given substantially even treatment in the shear zone areas. The ratio of shear field strengths may be up to 10:1 with a narrow rotor. That is the material occupies a volume having an outer radius ten times larger than the inner radius. Preferably the device will be designed to have a ratio approaching unity, but the desirability of evenness of shear zone strength must be balanced against the requirement for a path section providing an acceptable throughput. In the device described the ratio is about two.

The provision of substantially even shear treatment along a radial dimension may also be provided by selecting the dimensions of the apertures in the discs. The shear field at a point is proportional to the distance (d) from the rotational axis and the aperture dimensions are preferably chosen so that the ratio of 'd' at any point to the throughput at that point is substantially constant.

EXAMPLES

Examples of the process will now be described to illustrate but not limit the invention.

The process to be described utilized the cavity transfer mixer described previously and the following four bases were used as sources for acyl isethionate and soap. Amounts are quoted in weight precentages.

| | |
|---|---|
| Acyl Isethionate Base A: | |
| Sodium acyl (hardened coconut) isethionate | 71% |
| Stearic acid | 15% |
| Coconut fatty acid | 4% |
| Sodium isethionate | 7% |
| Moisture | 2% |
| Remainder | 1% |
| Acyl Isethionate Base B: | |
| Sodium acyl (hardened coconut) isethionate | 50% |
| Sodium soap (tallow 80/coconut 20) | 8% |
| Sodium isethionate | 5% |
| Stearic acid | 20% |
| Coconut fatty acids | 3% |
| Moisture | 5% |
| Remainder | 7% |

Soap Base C:

Sodium soap (10% moisture) obtained from feedstock of 60% tallow 40% coconut oil with 7.5% of the feedstock acids present as free fatty acids.

Soap Base D:

Sodium soap obtained from feedstock of 82% hardened tallow and 18% coconut oil.

EXAMPLE I

Acyl Isethionate Base B (50 kilogram) and Soap Base C (50 kilogram) were obtained in particulate form and coarsely mixed in a blade mixer for 10 minutes. The mixture was then milled twice to provide a mixture with a moisture content of between 6 and 7 percent. The mixture was separated into five 20 kilogram batches and each part batch passed under varying conditions of temperature through the cavity transfer mixer (CTM) described previously. The cavity transfer mixer contained a heating jacket which allowed the application of heat during use with the aid of an oil supply. The mixture was fed to the cavity transfer mixer from a standard soap plodder. The cavity transfer mixer was operated at 145 rpm and the operating conditions of the five batches are shown in Table I.

TABLE I

| Batch | 1 | 2 | 3 | 4 | 5 |
|---|---|---|---|---|---|
| Oil temperature | No heating applied | 50° C. | 90° C. | 120° C. | 160° C. |
| Mixture temperature at plodder outlet | 21 to 24.5 | 27.5/31.5 | 33.5 to 34.5 | 33.5 to 37.0 | 33.0 to 35.5 |
| Mixture temperature at CTM outlet | 60° to 61° | 64/66 | 68/70 | 73/74 | 83/86 |
| Throughput Kg $min^{-1}$ | 0.68 | 0.67 to 0.74 | 0.76 to 0.89 | 0.76 to 0.79 | 0.65 to 0.76 |

Temperatures are quoted in °C.

The material obtained was milled, plodded and pressed into tablets. The tablets from each batch were found to be grit free and smooth in texture.

EXAMPLE II

Five batches of Acyl Isethionate Base A and Soap Base D (12.5% moisture) were prepared in a range of formulations. The bases were coarsely mixed in particulate form with the aid of a ribbon mixer, milled and fed through the CTM with the aid of a soap plodder. The soap exit temperature was in the range 68° to 72° C. and the extrudate was plodded and stamped into bars. These bars were found to have grit free properties. The formulations were prepared with the weight ratios 90:10, 70:30, 50:50, 30:70, and 10:90 on the anhydrous bases. The moisture contents of the final products were in the range of 7.7 to 9.4%.

EXAMPLE III

Acyl isethionate base B (47.5 kg) and soap base D with 14% moisture (59 kg) were obtained in particulate form and mixed. Sufficient water was added to provide a mixture with a moisture content of 12%. The mixture was passed through the cavity transfer mixer described previously supplied from a soap plodder. The throughput was 0.6 kg $min^{-1}$ and the exit temperature of the mixture in the range 70° C. to 72° C.

The extrudate was cooled to ambient temperature and passed through the cavity transfer mixer again at a throughput of 0.6 kg $min^{-1}$. The exit temperature was in the range 25° C. to 27° C.

The extrudate was milled, air dried to about 9% moisture plodded and pressed into tablets. The latter were found to be grit free and smooth in texture.

We claim:

1. A process for preparing a detergent bar comprising:

(i) mixing water-soluble salts of long chain ($C_8$ to $C_{22}$) monocarboxylic acids and water-soluble acyl ($C_8$ to $C_{22}$) isethionates in the weight ratio of 95:5 to 60:40 respectively, and subjecting said mixture to temperatures in the range of from 60° C. to about 90° C. under conditions of shear; and (ii) extruding said mixture to form a detergent bar.

2. A process according to claim 1 wherein the weight ratio of monocarboxylic acid salts to isethionates is from about 80:20 to about 60:40.

3. A process according to claim 1 wherein the mixing under shear takes place in an enclosed environment.

4. A process according to claim 1 wherein the two materials are mixed in particulate form.

5. A process according to claim 1 wherein the mixture of materials is subjected to substantially even shear by passing the material at an angle through a plurality of shear zone areas formed within the detergent material bulk by relative movement of surfaces between which the material passes, the shear zone areas being formed within the material by entraining temporarily material in the surfaces so that a velocity component of the material is altered by the relative movement during entrainment.

6. A process according to claim 5 wherein the mixture of materials is passed between two closely spaced mutually displaceable surfaces, each having a pattern of cavities which overlap during movement of the surfaces, so that material moved between the surfaces traces a path through cavities alternately in each surface so that the bulk of the material passes through the shear zone generated by displacement of the surfaces.

* * * * *